US005899753A

United States Patent [19]

Wong et al.

[11] Patent Number: 5,899,753

[45] Date of Patent: May 4, 1999

[54] SPRING-LOADED BALL CONTACT CONNECTOR

[75] Inventors: Tse E. Wong, Los Alamitos; Harold M. Cohen, Los Angeles; Mohi Sobhani, Encino, all of Calif.

[73] Assignee: Raytheon Company, Lexington, Mass.

[21] Appl. No.: 08/834,789

[22] Filed: Apr. 3, 1997

[51] Int. Cl.[6] ..... H01R 39/00

[52] U.S. Cl. ..... 439/17; 439/22; 439/824

[58] Field of Search ..... 439/22, 27, 700, 439/824, 936, 884, 887, 891, 17, 19

[56] References Cited

U.S. PATENT DOCUMENTS

| | | | |
|---|---|---|---|
| 1,390,607 | 9/1921 | Farmer | 439/700 |
| 2,210,418 | 8/1940 | Larson | 439/700 |
| 2,224,343 | 12/1940 | Grimaldi | 439/17 |
| 3,363,220 | 1/1968 | Redd et al. | 439/700 |
| 3,416,125 | 12/1968 | Theve | 439/700 |
| 5,417,595 | 5/1995 | Cullen et al. | 439/700 |
| 5,484,294 | 1/1996 | Sobhani | 439/21 |

*Primary Examiner*—Gary Paumen

*Attorney, Agent, or Firm*—Leonard A. Alkov; Glenn H. Lenzen, Jr.

[57] ABSTRACT

A spring-loaded ball contact device having a housing, a spring disposed in the housing, a moveable plunger disposed in the housing that contacts the spring, a freely moveable ball contact disposed at an end of the plunger, and a lubricant stored within the housing for lubricating the ball contact. A rotary connector using the spring-loaded ball contact devices has first and second printed wiring boards that rotate relative to each other that are electrically interconnected using a plurality of spring-loaded ball contact devices disposed on the first printed wiring board. The spring-loaded ball contact devices are used to transfer electrical signals or power to conductive contacts formed on the second printed wiring board.

12 Claims, 2 Drawing Sheets

SPRING-LOADED BALL CONTACT CONNECTOR

BACKGROUND

The present invention relates to rotary connectors, and more particularly, to an improved spring-loaded rotary connector using spring loaded rotating ball contacts.

In prior ball-based spring-loaded rotary connectors developed by the assignee of the present invention, the connectors have only provided zero-, one- or two-degree-of-freedom motion, which results in relatively large wear-out of certain components of the connectors. This causes a loss of the contact between the contacts of the connector and a flat flexible printed wiring board to which the contacts mates.

For a connector with a bump- or dimple-type contact located between two flat flexible printed circuits, such as is disclosed in U.S. Pat. No. 5,484,294, entitled "Brushless Rotary Connector", for example, which patent is assigned to the assignee of the present invention, relatively tight tolerances in the distance between two flat flexible printed circuits and in the size of the bumps or dimples are required. For a connector with one-degree-of-freedom motion along an axial direction of its contacts, such as is disclosed in U.S. patent application Ser. No. 08/724,591, filed Sep. 30, 1996, entitled "Spring Loaded Contact Device and Rotary Connector", for example, also assigned to the assignee of the present invention, the connector uses spring-loaded plungers having round shaped heads.

It has been found that misalignment (tilt angle) and variation in the compression distance for each plunger, which causes the change in the spring restoring force applied in the plunger, occur during the installation process for the connector disclosed in the above-cited patent application. These two conditions can result in relatively large variations in the friction forces exerted in the connector during operation because the contacts are not free to move in directions perpendicular to the axis of the plunger.

For a connector having two-degree-of-freedom motion in directions parallel to the surface of the flat flexible printed circuits (such as in connectors using bearing balls), the relatively tight tolerances in the distance between two flat flexible printed circuits and in the size of the bearing balls are required. U.S. Pat. No. 5,575,664 issued Nov. 19, 1996 entitled "Ball Contact Rotary Connector", assigned to the assignee of the present invention describes this type of connector. In addition, to ensure full contact between the connectors and the flat flexible printed circuits in a vibration environment, an adequate spring load applied in the plunger or smaller tolerance for the connectors with bump-, dimple- or ball-bearing-type is required. The more severe in vibration environment, the higher spring load or smaller tolerance is necessary, which results in higher friction force applied in the plunger's tip or connectors.

Therefore, it is an objective of the present invention to provide for an improved spring-loaded rotary connector using spring-loaded rotating ball contacts.

SUMMARY OF THE INVENTION

In order to meet the above and other objectives, the present invention is a rotary connector comprising a spring-loaded plunger, that is inserted into a housing and whose tip is equipped with a free-rotating ball. The connector is used to couple electrical signals between two flat flexible printed circuits, which rotate relatively to each other. In the present invention, a large working stroke is provided along an axial direction of the plunger by a spring restoring force applied to the plunger. Motion in the other two directions, which are perpendicular to the axial direction of the plunger, are provided by the free-rotating ball at the tip of the plunger. Therefore, the present invention provides three-degree-of-freedom motion to significantly reduce the friction forces applied in the components.

This results in much longer operating lives for these components and also minimizes electrical power consumption for rotating the flat flexible printed circuits. In addition, the performance of the present connector is insensitive to the misalignment of the connector and the variation in the distance between two flat flexible printed circuits that occur during the connector installation and operation. Thus, robust designs for the connector are achieved by using the present invention.

The present invention improves the reliability of the rotary connector to provide for long life operation. In previous designs, the connector could only provide zero-, one- or two-degree-of-freedom motion, which resulted in the occurrence of relatively large reaction force(s) along the constraint direction(s) and induced excessive wear-out on the components. However, in the present invention, the rotary connector provides three-degree-of-freedom motion, which significantly reduces the wear-out of the components and achieves the long life operating reliability.

The present invention provides the following advantages. The forces applied at the interface between the tip of the plunger and the track of the flat flexible printed circuits are minimum when the flat flexible printed circuits rotate relative to each other by contacting the tips of the plungers. The electric power consumption for the rotating flat flexible printed circuit connector is minimum. Contamination caused by particles is minimized. A larger variation in flatness between the two flat flexible printed circuits is acceptable. The performance of the connector is insensitive to variation in the size of the free-rotating ball and misalignment of the connector caused during connector installation. The connector easily survives severe vibrational environments.

Using the present invention, the friction force experienced in conventional connectors is significantly reduced. Therefore, the present invention can survive severe vibration environments by using stiffer springs to provide higher spring loads on the plungers and maintain full contact for electrical signal coupling while only having minimum friction force applied in the plunger. Thus, the present invention provides for a connector having three-degree-of-freedom contact motion. The present invention also provides for a rotary connector that is robust in terms of installation of the contacts and the operating performance.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
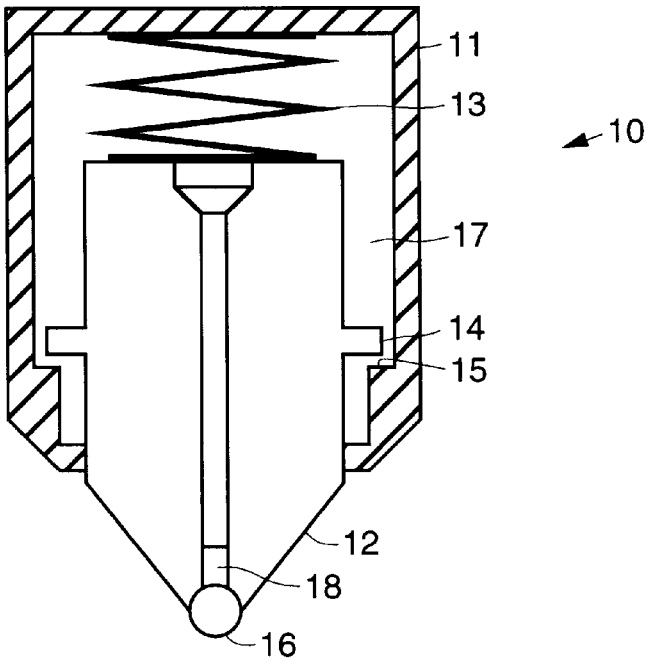
FIG. 1 shows a cross sectional view of a first embodiment of a spring-loaded ball contact device in accordance with the principles of the present invention.
Figure 2:
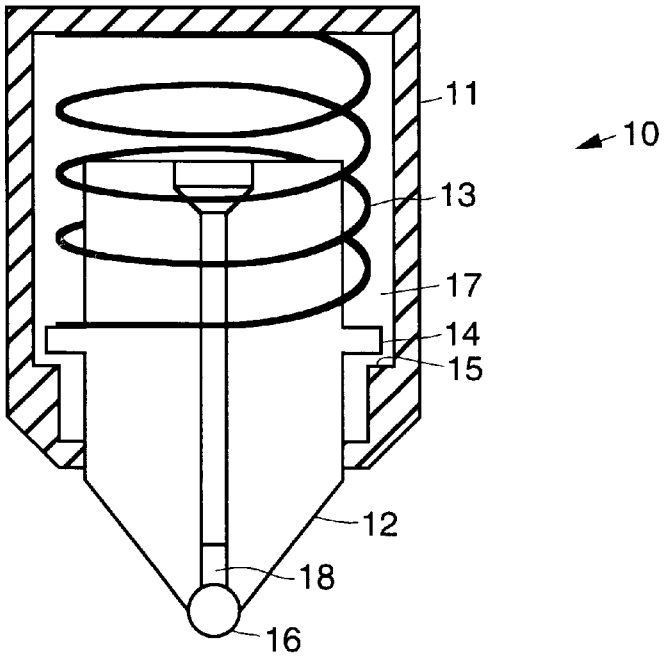
FIG. 2 shows a cross sectional view of a second embodiment of the spring-loaded ball contact device.
Figure 3:
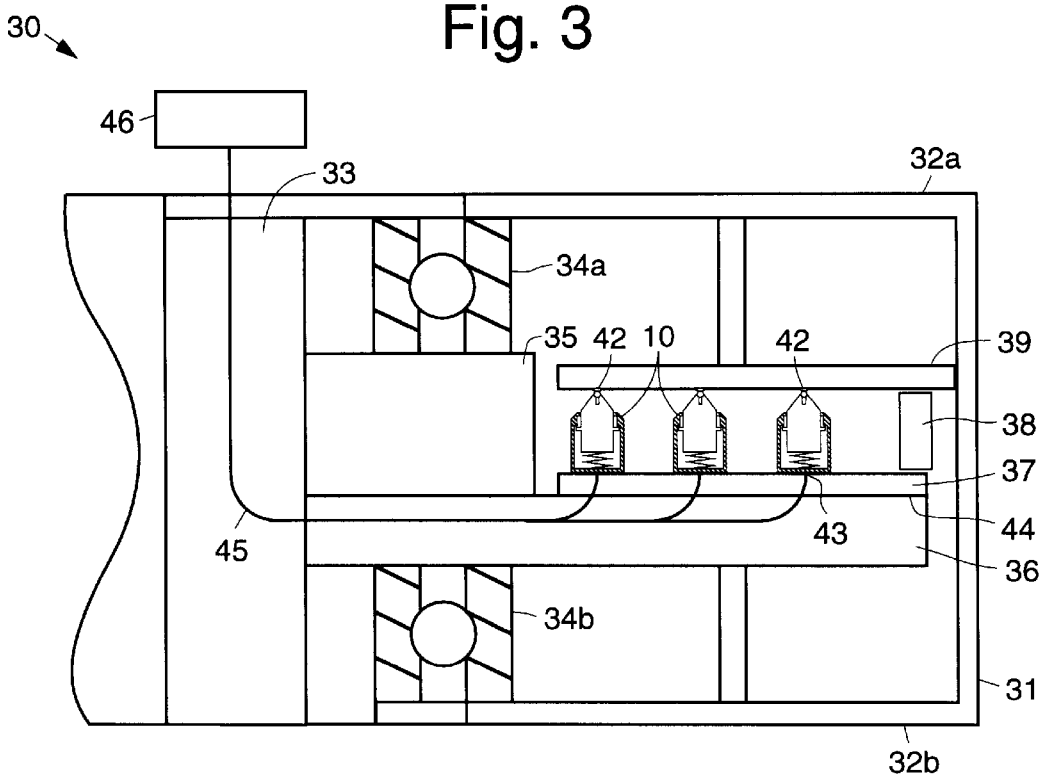
FIG. 3 illustrates an enlarged cross sectional side view of a spring-loaded rotary connector in accordance with the present invention employing a plurality of spring-loaded ball contact devices shown in FIGS. 1 or 2.
Figure 4:
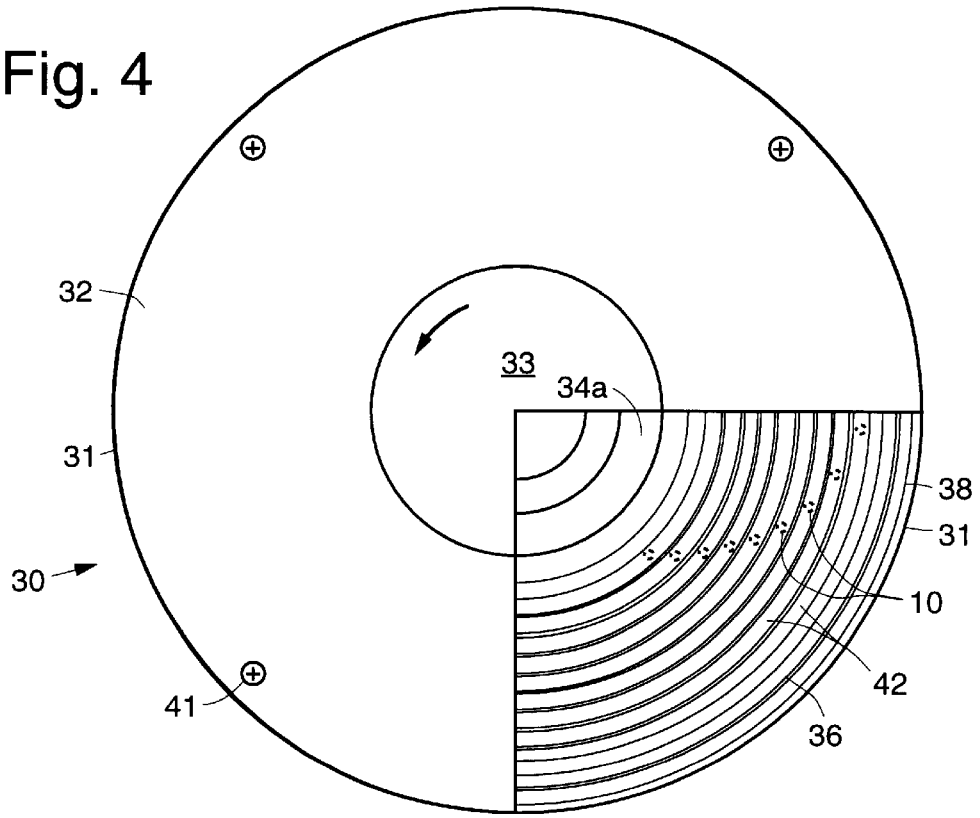
FIG. 4 illustrates a bottom view of the spring-loaded rotary connector shown in FIG. 3.

Referring to the drawing figures, FIGS. 1 and 2 show cross sectional views of two embodiments of spring-loaded ball contact devices 10 in accordance with the principles of the present invention that may be used to produce an improved spring loaded rotary connector 30 (FIGS. 3 and 4). The spring-loaded ball contact device 10 shown in FIG. 1 comprises a conductive metal housing 11 which houses a moveable plunger 12 that is spring loaded by means of a spring 13. The plunger 12 is free to move along an axial direction of the housing 11 and has force exerted on it by means of the spring 13. Downward (or upward) motion of the plunger 12 is stopped by a radial flange 14 and internal step 15 in the housing 11.

The spring 13 in the embodiment shown in FIG. 1 is disposed between the end of the plunger 12 and an internal surface of the housing 11 distal from the ball contact 16. The spring 13 in the embodiment shown in FIG. 2 is disposed around the exterior of the of the plunger 12 and one end contacts a surface of the radial flange 14 while the other end contacts the internal surface of the housing 11 distal from the ball contact 16.

The plunger 12 captivates a ball contact 16 that is free to rotate at the end of the plunger 12. A lubricant 17 is stored within the housing 11 and is free to migrate to a lubrication reservoir 18 disposed adjacent to the ball contact 16. The lubricant 17 is dispensed from the reservoir 18 by way of an opening through the plunger 12 and onto the ball contact 16 during motion thereof and allows the ball contact to move freely at the end of the plunger 12.

The housing 11, plunger 12, spring 13 and ball contact 16 may be comprised of brass, beryllium copper, high purity gold, or other conductive material. The lubricant may be an electrically insulative lubricant oil such as NPT-4 that is available from Bryco Micronic, for example.

FIG. 3 illustrates an enlarged cross sectional side view of a spring-loaded rotary connector 30 employing a plurality of spring-loaded ball contact devices 10 such as those shown in FIGS. 1 or 2. FIG. 4 illustrates a partially exposed full bottom view of the spring-loaded rotary connector 30 of FIG. 3. For the purposes of clarity, only a small number of spring-loaded ball contact devices 10 are shown in FIG. 3.

The spring-loaded rotary connector 30 is illustrated with reference to its use in a shaft-type application, wherein its rotatable components are coupled to a shaft 33 that rotates relative to a fixed enclosure 31. However, it is to be understood that the connector 30 may be designed so that the enclosure 31 rotates relative to a fixed shaft 33.

The exemplary rotary connector 30 is comprised of a enclosure 31 having first and second covers 32*a*, 32*b* that may be secured to the enclosure 31 by means of a plurality of screws 41 (FIG. 4), for example. A rotatable shaft 33 is disposed through the center of the enclosure 31, and a disk 36 and collar 35 extend radially outward from the shaft 33. First and second bearings 34*a*, 34*b* are coupled to the shaft 33 on opposite sides of the disk 36 and the collar 35. The first and second covers 32*a*, 32*b* secure outer races of the bearings 34*a*, 34*b*. Thus the shaft 33, disk 36, and collar 35 rotate with respect to the enclosure 31 and covers 32*a*, 32*b*.

A first printed wiring board 37 is secured to the disk 36 by means of adhesive 44, such as a thin layer of double sided adhesive tape 44, for example. The first printed wiring board 37 has a plurality of conductive traces 43 or contacts 43 that are connected to a plurality of spring loaded contact devices 10. The spring-loaded ball contact devices 10 may be coupled to a plurality of plated holes, for example, formed in the first printed wiring board 37. The plurality of conductive traces 43 or contacts 43 are connected (such as by soldering) by way of a plurality of wires 45 to a connector 46. The plurality of spring-loaded ball contact devices 10 contact a corresponding plurality of electrically isolated conductive traces 42 disposed on a second printed wiring board 39. The second printed wiring board 39 is secured to the enclosure 31. The plurality of electrically isolated conductive traces 42 are typically connected to a sensor or other device (not shown). A spacer 38 is disposed between the first and second printed wiring boards 37, 39. The spacer 38 is used to control the amount of deflection of the first and second printed wiring boards 37, 39, and hence the amount of deflection of the spring-loaded rotary connector 30.

As should be readily apparent, the spring-loaded ball contact devices 10 slide on the conductive traces 42 when the first printed wiring board 37 rotates with respect to the second printed wiring board 39. The rotation of the shaft 33 relative to the enclosure 31 is represented by the arrow in FIG. 4. Consequently, electrical signals are transferred from the first printed wiring board 37 to the second printed wiring board 39 by way of the spring-loaded ball contact devices 10 and the conductive traces 42 on the second printed wiring board 39.

The spring-loaded rotary connector 30 permits relative angular movement between the shaft 33 and the enclosure 31 that secures the second printed wiring board 39. The spring-loaded rotary connector 30 also compensates for movement between the first and second printed wiring boards 37, 39 in terms of their separation distance. More specifically, if the respective planes of the first and second printed wiring boards 37, 39 are not parallel, then the plungers 12 of the spring-loaded ball contact devices 10 adjust for the differences in distance therebetween. This may be caused by vibration of a vehicle, for example, or relative movement between the components that are connected to the shaft 33 and the enclosure 31 to which the second printed wiring board 39 is secured. This might be the relative movement between an axle and a wheel of a vehicle, for example. The relative motion is compensated for by the round ball contacts 16 of the spring-loaded ball contact devices 10 which operate to keep electrical contact with the respective conductive traces 42 irrespective of the relative angular relationship between the first and second printed wiring boards 37, 39.

The spring-loaded rotary connector 30 is shown as comprising flat printed wiring boards 37, 39 that are designed to engage the shaft 33. However, it is to be understood that contoured printed wiring boards 37, 39 such may be provided by cylindrical or spherical printed wiring boards 37, 39, for example, may be employed as well as flat printed wiring boards 37, 39. Therefore, the connector 30 is not limited to a flat configuration.

The general design concepts of the present invention are similar to those described in U.S. Pat. No. 5,484,294 assigned to the assignee of the present invention. However, the present spring-loaded ball contact device 10 comprises a spring-loaded plunger 12 inserted into a housing 11 and equipped with a free-rotating ball 16 at the tip of the plunger 12. In the present invention, and to provide a better electrical contact and easy installation, a gold-plated spring 13 and the housing 11 is made with a material that can be soldered or welded, such as copper or brass, for example.

In the present invention, the motion along the axial direction of the plunger 12 is provided by a restoring spring force or working stroke of the plunger 12. Since this working stroke is relatively large, a large variation in the distance between the two flat flexible printed wiring boards 37, 39 may be accommodated. Conductive contact to couple electrical signals through the spring-loaded ball contact device 10 is maintain by the spring restoring force applied in the plunger 12. The other two-degree-of-freedom motions are provided by the free-rotating ball 16 mounted at the tip of the plunger 12, which also minimizes the force applied perpendicular to the plunger 12. Therefore, a total resultant force applied to the spring-loaded ball contact device 10 is minimized and long life operating reliability of the spring-loaded ball contact device 10 is achieved, which also provides for improvement operating reliability of the connector 30.

The spring-loaded ball contact devices 10 and the rotary connector 30 employing them have been designed to withstand harsh outdoor environments such as when the connector 30 is used in conjunction with axles of automobiles and trucks, for example. The rotary connector 30 may be used to transmit power or signals from a stationary object to a moving object. The rotary connector 30 has been developed to replace existing slip-ring type connectors conventionally used in many aircraft and vehicle applications. The spring loaded rotary connector 30 is rugged and performs well in harsh outdoor environments. The spring-loaded ball contact devices 10 and the rotary connector 30 in which they are employed may be used in cars, trucks, motor homes, motorcycles, and aircraft, wherever rotary electrical connectors are used.

Thus, spring-loaded rotary connectors having an improved spring-loaded ball contact device have been described. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. A spring-loaded ball contact device for use in a rotary connector, said contact device comprising:

a housing;

a spring entirely disposed within the housing;

a moveable plunger disposed in the housing that contacts the spring;

a ball contact disposed at an end of the plunger; and a lubricant stored within the housing for lubricating the ball contact.

2. The device of claim 1 wherein motion of the plunger is stopped by a radial flange and internal step in the housing.

3. The device of claim 1 wherein the spring is disposed between an end of the plunger and an internal surface of the housing distal from the ball contact.

4. The device of claim 2 wherein the spring is disposed around an exterior surface of the plunger and one end contacts a surface of the radial flange while the other end contacts an internal surface of the housing distal from the ball contact.

5. The device of claim 1 further comprising a lubrication reservoir disposed adjacent to the ball contact.

6. The device of claim 1 wherein the housing, plunger, spring and ball contact comprise brass.

7. The device of claim 1 wherein the housing, plunger, spring and ball contact comprise beryllium copper.

8. The device of claim 1 wherein the housing, plunger, spring and ball contact comprise high purity gold.

9. A rotary connector comprising:

an enclosure;

a rotatable shaft disposed through the enclosure;

a disk extending radially outward from the shaft;

a collar extending radially outward from the shaft;

first and second bearings coupled to the shaft on opposite sides of the disk and the collar;

a first printed wiring board secured to the disk having a plurality of conductive contacts that are electrically connected to a plurality of spring-loaded ball contact devices, and wherein each of the plurality of spring-loaded ball contact devices comprises:

a housing;

a spring entirely disposed within the housing;

a moveable plunger disposed in the housing that contacts the spring;

a ball contact disposed at an end of the plunger; and a lubricant stored within the housing for lubricating the ball contact;

a connector electrically connected to the plurality of conductive contacts and spring-loaded ball contact devices; and a second printed wiring board coupled to the enclosure that has a plurality of electrically isolated conductive traces disposed thereon that respectively contact the plurality of spring-loaded ball contact devices.

10. The rotary connector of claim 9 further comprising a spacer disposed between the first and second printed wiring boards.

11. The rotary connector of claim 9 wherein the first printed wiring board is secured to the disk by means of adhesive.

12. The rotary connector of claim 9 wherein the first printed wiring board is secured to the disk by means of a layer of double sided adhesive tape.

* * * * *